United States Patent [19]

Shiga et al.

[11] 4,442,202

[45] Apr. 10, 1984

[54] POST-ACTIVATION TYPE DRY IMAGE FORMING MATERIAL

[75] Inventors: Tetsuo Shiga; Takeo Kimura; Yoshinobu Ito; Kageyasu Akashi; Minoru Akiyama; Takeki Matsui, all of Shizuoka, Japan

[73] Assignee: Asahi Kasei Kogyo Kabushiki Kaisha, Osaka, Japan

[21] Appl. No.: 468,692

[22] Filed: Feb. 28, 1983

Related U.S. Application Data

[63] Continuation of Ser. No. 346,305, Feb. 5, 1982, abandoned, which is a continuation of Ser. No. 139,951, Apr. 14, 1980, abandoned.

[30] Foreign Application Priority Data

Apr. 16, 1979 [JP] Japan ..... 54-45257

[51] Int. Cl.[3] ..... G03C 1/02

[52] U.S. Cl. ..... 430/600; 430/599; 430/608; 430/612; 430/619; 430/620

[58] Field of Search ..... 430/619, 617, 620, 607, 430/612, 599, 600, 608

[56] References Cited

U.S. PATENT DOCUMENTS

| | | | |
|---|---|---|---|
| 3,457,075 | 7/1969 | Morgan et al. . | |
| 3,707,377 | 12/1972 | Van Dyke et al. . | |
| 3,802,888 | 4/1974 | Willits . | |
| 3,846,136 | 11/1974 | Sullivan | 430/617 |
| 4,201,583 | 5/1980 | Reithel | 430/619 |
| 4,234,679 | 11/1980 | Akashi et al. | 430/619 |

FOREIGN PATENT DOCUMENTS

| | | | |
|---|---|---|---|
| 2934751 | 3/1980 | Fed. Rep. of Germany | 430/619 |
| 54-5687 | 3/1979 | Japan . | |

*Primary Examiner*—Won H. Louie, Jr.
*Attorney, Agent, or Firm*—Sprung, Horn, Kramer & Woods

[57] ABSTRACT

A post-activation type dry image forming material comprising (I) a silver salt component reducible to free silver upon light exposure and including silver iodide; (II) a redox reactive composition capable of making a visual change by a redox reaction of said composition, said reaction being initiated by heating in the presence of free silver; (III) an oxidizing agent for free silver which has an oxidizing capacity for free silver but is rendered photosensitive by heating and which, upon light exposure after said heating, is suppressed with respect to the oxidizing capacity for free silver and capable of catalytically promoting the redox reaction of said composition; and (IV) a photoreactive oxidizing agent, upon light exposure, capable of returning the reduced oxidizing agent for free silver to the original state. A post-activation type dry image forming material which is extremely excellent in stability of the raw image forming material, that is, can be stored in a light room for a time as long as a period of the order of years and which has high sensitivity can, for the first time, be realized by the ingenious combination of components. The effect of the interaction between the components, especially between the components (I), (III) and (IV) is noticeable in imparting to the present image forming material an extremely high stability of the raw image forming material.

5 Claims, No Drawings

POST-ACTIVATION TYPE DRY IMAGE FORMING MATERIAL

This application is a continuation of application Ser. No. 346,305, filed Feb. 5, 1982 now abandoned which is a continuation of application Ser. No. 139,951 filed Apr. 14, 1980 now abandoned.

This invention relates to a dry image forming material. More particularly, the present invention relates to a post-activation type dry image forming material which is non-photosensitive under normal lighting conditions but is rendered photosensitive by heating and which can record thereon an image only by a dry process.

As a photosensitive material on which an image can be formed only by a dry process, there has heretofore been proposed a photosensitive material comprising an organic silver salt oxidizing agent, a reducing agent for reducing a silver ion and a catalytic amount of a silver halide. Particular examples of such a proposed photosensitive material include post-activation type dry image forming materials which are described in U.S. Pat. Ser. Nos. 3,802,888 and 3,764,329. These proposed post-activation type dry image forming materials, however, are defective in that they are poor in light stability of the raw image forming material or in sensitivity of the image forming material. In the latter case, by incorporating into the material a sensitizing agent, the poor sensitivity can be improved. In this instance, however, the incorporation of the sensitizer inevitably leads to lowering of light stability of the raw image forming material. Therefore, any of the heretofore proposed post-activation type dry image forming materials is poor in light stability of the raw image forming material and can be stored in a light room only for a time as short as a period of the order of hours, so that it is hardly provided for practical use. As stated above, the conventional post-activation type dry image forming materials are insufficient for practical use with respect to light stability of the raw image forming materials.

With a view to developing a post-activation type dry image forming material which can be practically useful, the present inventors have made extensive and intensive researches. As a result, it has been found that a novel post-activation type dry image forming material comprising specific components as defined in appended claims attains excellent stability of the raw image forming material over a semi-permanently long period of time and high sensitivity sufficient for practical use. The present invention has been made based on such a novel finding.

It is accordingly an object of the present invention to provide a post-activation type dry image forming material which is extremely excellent in stability of the raw imaging material, that is, can be stored in a light room for a time as long as a period of the order of years.

It is another object of the present invention to provide a post-activation type dry image forming material of the above character, which has such a high sensitivity as enables photographing by using a camera to be carried out.

The foregoing and other objects, features and advantages of the present invention will be apparent to those skilled in the art from the following detailed description and appended claims.

According to the present invention, there is provided a post-activation type dry image forming material comprising:

(I) a silver halide component reducible to free silver upon being exposed to light and including silver iodide;

(II) a redox reactive composition capable of making a visual change according to a redox reaction of said composition, the redox reaction being initiated by heating said composition in the presence of free silver;

(III) an oxidizing agent for free silver which has a capacity of oxidizing free silver and is capable of being rendered photosensitive by heating, said oxidizing agent for free silver, upon being exposed to light after said heating, being suppressed with respect to the capacity of oxidizing free silver and capable of catalytically promoting the redox reaction of said redox reactive composition; and (IV) a photoreactive oxidizing agent, upon being exposed to light, capable of returning to the original state said oxidizing agent for free silver which is reduced simultaneously with oxidation of the free silver by the action of said oxidizing agent for free silver.

The term "redox reactive composition" used herein is intended to mean a composition comprising an oxidizing ingredient and a reducing ingredient therefor and capable of undergoing the redox reaction between the oxidizing and reducing agents, said redox reaction being initiated by heating in the presence of free silver.

In accordance with the present invention, the post-activation type dry image forming material is remarkably improved with respect to stability of the material prior to activation, i.e., stability of the raw image forming material as well as sensitivity. The reason for this is believed to be as follows. In the post-activation type dry image forming material, the silver halide component (I) present therein prior to activation of the material is photochemically reduced by the action of light during the storage of the raw image forming material in a light room to form free silver in part of the silver halide crystals. The free silver thus formed, if left as it is, exerts a catalytic activity for promoting the redox reaction of the redox reactive composition as the component (II) capable of making a visual change. In this instance, however, the free silver is oxidized by the action of the oxidizing agent for free silver as the component (III) to reconvert the free silver into the original silver halide, leading to extinguishment of the above-mentioned catalytic activity to be exerted by the free silver. The oxidizing agent for free silver having served to oxidize the free silver to the silver halide, itself, is in a reduced state. The reduced oxidizing agent for free silver, in turn, is oxidized by the action of the photoreactive oxidizing agent as the component (IV) so that it is returned to the original state in which the capacity of oxidizing free silver is regenerated. As is clearly understood from the foregoing explanation, the reason for the excellent stability of the raw image forming material (material prior to activation by heating) is believed to reside in the skillful combination of components involved in the post-activation type dry image forming material of the present invention. Illustratively stated, due to the copresence of the components (I), (III) and (IV), the component (III) reduced by having served to reconvert the light-produced free silver into the component (I) is regenerated (oxidized) by the action of the component (IV). This is a completely novel concept that leads to realization of a post-activation type dry image forming material having stability of the raw image forming material sufficient for practical use.

Silver iodide is superior in thermal stability to silver bromide and silver chloride. Further, the free silver formed in silver iodide crystals has a low redox potential and therefore is easily oxidized as compared with those produced in silver bromide crystals and silver chloride crystals. Accordingly, when the silver halide component (I) has, as an ingredient thereof, silver iodide incorporated therein, the free silver photochemically produced in part of silver halide crystals can be easily oxidation-reconverted into the original silver halide by the action of the oxidizing agent for free silver as the component (III). The above-mentioned low redox potential of the free silver and thermal stability of silver iodide contribute to excellent stability of the raw material of the present image forming material containing silver iodide.

The oxidizing agent for free silver as the component (III) is rendered photosensitive upon being activated by heating. When the present image forming material activated by heating is image-wise exposed to light, the oxidizing agent for free silver as the component (III) in the light-exposed portions is suppressed with respect to the capacity of oxidizing free silver and, at the same time, is caused to exert a catalytic activity for promoting the redox reaction of the redox reactive composition as the component (II). Therefore, in the above-mentioned light-exposed portions of the post-activated image forming material of the present invention, the free silver produced from the silver halide component (I) is so stably present that it acts as a catalyst for the redox reaction of the redox reactive composition (II) by heating, thereby promoting a visual change of the component (II). As mentioned above, the component (III) also serves as a catalyst for the redox reaction of the redox reactive composition (II). Thus, when the light-exposed portions obtained by heat-activating the present post-activation type dry image forming material and subjecting the resulting activated material to image-wise light exposure are heated, the redox reaction of the redox reactive composition (II) in the light-exposed portions is effectively promoted to form a visual image (heat development). Whereas, in the light-unexposed portions, the oxidizing agent for free silver as the component (III) still retains its oxidizing capacity for free silver and, hence, serves to suppress the initiation and progress of a redox reaction of the redox reactive composition as the component (II) at the step of heat development. As a result, there is caused a remarkable difference in redox reaction rate of the composition (II) between the light-exposed portions and the light-unexposed portions, enabling the visual change by the heat development to be considerably amplified. This contributes to a large increase in sensitivity of the image forming material of the present invention. Furthermore, the inclusion of silver iodide in the silver halide component (I) is effective for such improvements in properties of the image forming material that the material, upon activation, is sensitive to a broadened range of wavelengths of light and that the material is excellent with respect to thermal stability and therefore is substantially prevented, at the heat development, from undergoing fogging whereby the amplitude of development can be increased. It is believed that these improvements contribute to an increase in sensitivity of the image forming material of the present invention.

With respect to the essential four components of the present post-activation type dry image forming material, a detailed explanation will now be given as follows.

It is requisite for the present invention that the silver halide component (I) include therein silver iodide. In order for the silver iodide to exert a sufficient effect for the purpose, it is preferable to employ silver iodide in an amount of at least 30 mole % based on the silver halide component (I). The more preferable amount of silver iodide is at least 50 mole % based on the silver halide component (I). From a viewpoint of sensitivity of the image forming material, it is desirable to employ as the silver halide component (I) those containing, besides silver iodide, at least 2 mole %, based on the component (I), of silver bromide and/or silver chloride, rather than those of 100 mole % of silver iodide. Furthermore, from a viewpoint of stability of the raw image forming material, it is desirable to employ as the silver halide component (I) those containing, besides silver iodide, silver bromide rather than silver chloride. Therefore, the most preferred silver halides constituting the silver halide component (I) are silver iodide and silver bromide. Silver iodide and silver bromide may be provided either in the form of a mixture thereof or a mixed crystal thereof . The molar ratio of silver iodide to silver bromide may be preferably 30/70 to 98/2, more preferably 50/50 to 95/5. The amount of the silver halide component (I) to be used may usually be 1 to 20 mole %, based on the amount of a non-photosensitive oxidizing ingredient of the redox reactive composition as the component (II) which will be described later in detail.

As to a method for incorporating the silver halide component (I) into the image forming material of the present invention, following is an explanation referring to an example in which there is used an organic silver salt oxidizing agent as the later-mentioned non-photosensitive oxidizing ingredient of the component (II). As one mode, there can be mentioned a method described in U.S. Pat. No. 3,152,904 specification in which a silver halide component is prepared and then mixed with an organic silver salt oxidizing agent which has been prepared separately. The silver halide component may be prepared by a process ordinarily employed in the field of photographic materials. As another mode, there can be mentioned a method described in U.S. Pat. No. 3,457,075 specification in which a previously prepared organic silver salt oxidizing agent is reacted with a suitable halogenating agent to convert part of the organic silver salt oxidizing agent to the corresponding silver halide.

In the latter of the above-mentioned two methods, as the suitable halogenating agent, there can be mentioned organic halides of elements belonging to Group IV, V or VI of the periodic table, halogens, complexes of halogens, organic haloamides containing a unit of the formula—CONX—wherein X is bromine or iodine, aryl-halomethanes and metal halides. They may be used alone or in combination. Specific examples of the halogenating agent include compounds respectively represented by the formulae

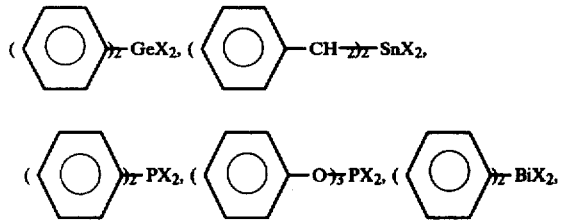

-continued

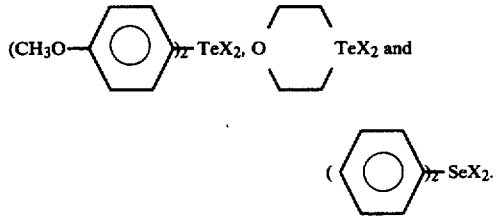

In the above formulae, X is bromine or iodine. Specific further examples of the halogenating agent include iodine, bromine, iodine bromide, a complex of triphenyl phosphite and iodine, a complex of p-dioxane and iodine, a complex of p-dioxane and bromine, N-bromo(or -iodo)phthalimide, N-bromo(or -iodo)phthalazinone, N-bromo(or -iodo)acetamide, N-bromo(or -iodo)acetanilide and α-bromo(or -iodo)diphenylmethane. Specific still further examples of the halogenating agent include $CoX_2$, $NiX_2$, $MgX_2$, $BaX_2$, RbX, CsX, $TeX_2$, $TeX_4$ and $AsX_3$. In these formulae, X is bromine or iodine. From the viewpoint of stability of the raw image forming material as well as sensibility, the preferred halogenating agents for forming silver iodide are iodine and complexes of iodine. Complexes of iodine such as a complex of triphenyl phosphite and iodine and a complex of p-dioxane and iodine are especially preferred. As the halogenating agent for forming silver bromide, it is desirable to employ cobalt dibromide and/or nickel dibromide.

As the redox reactive composition as the component (II), there can be mentioned a composition comprising a non-photosensitive oxidizing ingredient and a reducing ingredient therefor, for example, a composition comprising a non-photosensitive organic silver salt oxidizing agent and a reducing agent for a silver ion.

As the non-photosensitive organic silver salt oxidizing agent, silver salts of long chain fatty acids, which preferably have 12 to 24 carbon atoms, are especially suitable. Preferred examples of the silver salts of long chain fatty acids include silver behenate, silver stearate, silver palmitate, silver myristate, silver laurate and silver oleate. As other suitable non-photosensitive organic silver salt oxidizing agents, there can be mentioned, for example, the silver salts of saccharin, benzotriazole, 5-chloro or -nitro salicylaldoxime, phthalazinone and 3-mercapto-4-phenyl-1,2,4-triazole. They may be used either alone or in combination. The organic silver salt oxidizing agent may be used in an amount of about 0.1 to about 50 $g/m^2$, preferably 1 to 10 $g/m^2$ of the support area of the present image forming material.

As the reducing agent for a silver ion, there is used an organic reducing agent which has such a suitable reducing ability that, when heated, it reduces the non-photosensitive organic silver salt oxidizing agent with the aid of catalysis of the free silver produced in the exposed portions of the activated dry image forming material to form a visual image. Examples of the reducing agents include monohydroxybenzenes such as p-phenylphenol, p-methoxyphenol, 2,6-di-tert-butyl-4-methylphenol and 2,5-di-tert-4-methoxyphenol; polyhydroxybenzenes such as hydroquinone, tert-butylhydroquinone, 2,6-dimethylhydroquinone, chlorohydroquinone and catechol; naphthols such as α-naphthol, β-naphthol, 4-aminonaphthol and 4-methoxynaphthol; hydroxybinaphthyls such as 1,1'-dihydroxy-2,2'-binaphthyl and 4,4'-dimethoxy-1,1'-dihydroxy-2,2'-binaphthyl; phenylenediamines such as p-phenylenediamine and N,N'-dimethyl-p-phenylenediamine; aminophenols such as N-methyl-p-aminophenol and 2,4-diaminophenol; sulfonamidophenols such as p-(p-toluenesulfonamido)phenol and 2,6-dibromo-4-(p-toluenesulfonamido)phenol; methylenebisphenols such as 2,2'-methylenebis(4-methyl-6-tert-butylphenol), 2,2'-methylenebis(4-ethyl-6-tert-butylphenol), 2,2'-methylenebis-[4-methyl-6-(1-methylcyclohexyl)phenol], 1,1-bis(2-hydroxy-3,5-dimethylphenyl)-3,5,5-trimethylhexane and 2,6-bis(2'-hydroxy-3'-tert-butyl-5'-methylbenzyl)-4-methylphenol; 3-pyrazolidones such as 1-phenyl-3-pyrazolidone and 4-methyl-4-hydroxymethyl-1-phenyl-3-pyrazolidone; and ascorbic acids. A suitable reducing agent may be chosen depending on the organic silver salt oxidizing agent employed in combination therewith. For example, when there is employed as the oxidizing agent a silver salt of a long chain fatty acid such as silver behenate which is relatively hard to reduce, a relatively strong reducing agent, e.g., a bisphenol such as 2,2'-methylenebis(4-ethyl-6-tert-butyl)-phenol is suitably employed. On the other hand, to organic silver salt oxidizing agents such as silver laurate which are relatively easy to reduce are suitable relatively weak reducing agents, e.g., substituted phenols such as p-phenylphenol and to organic silver salt oxidizing agents such as the silver salt of benzotriazole which are very hard to reduce are suitable strong reducing agents such as ascorbic acids. The silver ion reducing agent that is especially suitable for the post-activation type dry image forming material of the present invention is a hindered phenol in which one or two sterically bulky groups are bonded to the carbon atom or carbon atoms contiguous to the hydroxyl group-bonded carbon atom to sterically hinder the hydroxyl group. The hindered phenol has a high stability to light and, hence, the use of the hindered phenol is effective for assuring high storage stability of the raw image forming material. As examples of such hindered phenols, there can be mentioned 2,6-di-tert-butyl-4-methylphenol, 2,2'-methylenebis(4-methyl-6-tert-butylphenol), 2,2'-methylenebis(4-ethyl-6-tert-butylphenol), 1,1-bis(2-hydroxy-3,5-dimethylphenyl)-3,5,5-trimethylhexane, 2,6-methylenebis-(2-hydroxy-3-tert-butyl-5-methylphenyl)-4-methylphenol, 2,2'-methylenebis[4-methyl-6-(1-methylcyclohexyl)phenol] and 2,5-di-tert-butyl-4-methoxyphenol. These reducing agents may be used either alone or in combination. The amount of the reducing agent to be used varies depending on the kinds of organic silver salt oxidizing agent, reducing agent and other components to be used in the dry image forming material of the present invention. The suitable amount of the reducing agent is usually 1 to 100 % by weight, based on the amount of the organic silver salt oxidizing agent.

As described before, the oxidizing agent for free silver as the component (III) has a capacity of oxidizing free silver, and not only can be rendered photosensitive by heating but also, upon being exposed to light after said heating, is suppressed with respect to its capacity of oxidizing free silver while being caused to exert a catalysis effect for promoting the redox reaction of the redox reactive composition. As examples of the component (III), there can be mentioned a compound of divalent mercury ($Hg^{++}$), a compound of trivalent iron ($Fe^{+++}$), a compound of trivalent cobalt ($Co^{+++}$), a compound of divalent palladium ($Pd^{++}$) and a sulfinic acid compound. Referring to an example in which a mercuric compound is employed, the function of the component (III) will be illustratively explained. The mercuric compound has a capacity of oxidizing the free silver produced during the storage of the post-activation type dry image forming material. The mercuric compound, however, is converted to mercurous compounds including mercurous halide and rendered photosensitive by heat-activating the image forming material of the present invention. Upon image-wise light exposure, in the light-exposed portions of the heat-activated image forming material, the mercurous compound produces free mercury while the silver halide produces free silver. Thus, the light-exposed component (III) substantially loses a capacity of oxidizing the free silver,and the free mercury as well as the free silver formed and retained in the light-exposed portions serves as developing nuclei for the heat development of the image-wise light-exposed image forming material to obtain a visible image.

As examples of the compound of divalent mercury that may be used in the present invention, there can be mentioned mercuric salts of aliphatic carboxylic acids such as mercuric acetate and mercuric behenate, mercuric salts of aromatic carboxylic acids such as mercuric benzoate, mercuric m-methylbenzoate and mercuric acetamidobenzoate, mercuric halides such as mercuric bromide and mercuric iodide, mercuri-benzotriazole and mercuri-phthalazinone. Especially preferred are mercuric acetate, mercuric bromide and mercuric iodide. The amount of the compound of divalent mercury is suitably 0.2 to 7 mole % based on the amount of the above-mentioned non-photosensitive oxidizing ingredient (e.g. organic silver salt oxidizing agent) of the component (II).

As examples of the compound of trivalent iron that may be used in the present invention, there can be mentioned a complex of trivalent iron and acetylacetone and a complex of trivalent iron and bipyridyl. The amount of the compound of trivalent iron is suitably 0.01 to 1 mole %, based on the amount of the non-photosensitive oxidizing ingredient.

As examples of the compound of trivalent cobalt that may be used in the present invention, there can be mentioned complexes such as a complex of trivalent cobalt and acetylacetone and a complex of trivalent cobalt and o-phenanthroline, and cobaltic halides such as cobaltic iodide and cobaltic bromide. The amount of the compound of trivalent iron is suitably 0.01 to 1 mole %, based on the amount of the non-photosensitive oxidizing ingredient.

As examples of the compound of divalent palladium, there can be mentioned a complex of divalent palladium and acetylacetone and palladium(II) halides such as palladium(II) iodide and palladium(II) bromide. The amount of the compound of divalent palladium is suitably 0.01 to 10 mole %, based on the amount of the non-photosensitive oxidizing ingredient.

As examples of the sulfinic acid compound, there can be mentioned n-octylsulfinic acid and p-toluenesulfinic acid. The amount of the sulfinic acid compound is suitably 0.05 to 10 mole %, based on the amount of the non-photosensitive oxidizing ingredient.

As the component (III), the compounds of divalent mercury are most preferred.

As described before, the oxidizing agent for free silver [component (III)] is reduced by serving to oxidize the free silver produced during the storage of the raw image forming material into silver halide. The thus reduced oxidizing agent for free silver, in turn, is oxidized by the action of the photoreactive oxidizing agent as the component (IV), whereby it is effectively returned to the original state in which the component (III) has an oxidizing capacity for free silver. As examples of the photoreactive oxidizing agent as the component (IV), there can be mentioned halogeno compounds capable of generating free radicals of halogen upon light exposure. Preferred examples of such halogeno compounds are bromo compounds in which a bromine atom is bonded to a carbon atom.

Whether or not a given bromo compound is suitable for use as the component (IV) in the present invention can be determined, for example, by the photoreaction test as follows.

1 Mole of silver behenate [suitable as the silver behenate is one which has been synthesized in a mixed solvent (1:5–5:1 by volume) of water and at least one water-soluble or partially water-soluble alcohol having 3 to 8 carbon atoms], 450 g of polyvinyl butyral and 0.25 mole of a compound for use as the "photoreactive oxidizing agent" are dissolved into a mixed solvent (2:1 by weight) of methyl ethyl ketone and toluene, and then formed into a film using an ordinary casting method.

The film thus formed is tested with respect to the following two requirements. When the film satisfies both the two requirements, the compound (for use as the photoreactive oxidizing agent) employed is suitable for the purpose.

Requirement 1: when the film is examined by X-ray diffractometry, the peak due to silver bromide ($2\theta=31.0°$) should not be observed (the value of the intensity of the peak is less than about 10) relatively to 100 as the value of the intensity of the peak due to silver behenate ($2\theta=12.1°$)

Requirement 2: subsequently, the film is irradiated with a 20,000 luxes-light from a fluorescent lamp at 75° C. in an atmosphere of a relative humidity of 30% for 1 hour, and then examined by X-ray diffractometry again. The peak due to silver bromide ($2\theta=31.0°$) should be observed (the value of the intensity of the peak is about 10 or more) relatively to 100 as the value of the intensity of the peak due to silver behenate ($2\theta=12.1°$).

In the above test, the values of $2\theta$ are those of diffraction peaks obtained by using CuK$\alpha$ line. In the present invention, as the apparatus for X-ray diffractometry is used an apparatus of Rotor Unit type (RU-200 PL type) manufactured and sold by Rigaku Denki Kabushiki Kaisha, Japan.

Specific examples of the photoreactive oxidizing agent as the component (IV) include $\alpha,\alpha,\alpha',\alpha'$-tetrabromo-o-xylene, $\alpha,\alpha,\alpha',\alpha'$-tetrabromo-m-xylene, ethyl $\alpha,\alpha,\alpha$-tribromoacetate, $\alpha,\alpha,\alpha$-tribromoacetophenone, $\alpha,\alpha,\alpha$-tribromo-p-bromotoluene, 1,1,1-tribromo-2,2-diphenylethane, tetrabromomethane, 2,2,2-tribromoethanol, 2,2,2-tribromoethylcyclohexyl carbamate, 2,2,2-tribromoethylphenyl carbamate, 2,2,2-tribromoethyl benzoate, 2,2,2-tribromoethyl ethylcarbamate, 2-methyl-1,1,1-tribromo-2-propanol, bis(2,2,2-tribromoethoxy)diphenylmethane, 2,2,2-tribromoethyl stearate, 2,2,2-tribromoethyl-2-furoate, bis(2,2,2-tribromoethyl)succinate, 2,2,2-tribromoethyl phenylsulfonate, 2,2,2-tribromoethoxytrimethylsilane, 2,2,2-tribromo-1-phenylethanol, 2,2,2-tribromoethyldiphenyl phosphate. They may be employed alone or in combination. Of them, especially preferred are $\alpha,\alpha,\alpha',\alpha'$-tetrabromo-o-xylene, $\alpha,\alpha,\alpha',\alpha'$-tetrabromo-m-xylene, ethyl $\alpha,\alpha,\alpha$-tribromoacetate, α,α,α-tribromo-p-bromotoluene, α,α,α-tribromoacetophenone, 1,1,1-tribromo-2,2-diphenylethane, and 2,2,2-tribromoethanol. Most preferred are α,α,α',α'-tetrabromo-o-xylene and α,α,α',α'-tetrabromo-m-xylene. The amount of the photoreactive oxidizing agent (IV) is suitably 2.5 to 40 mole based on the amount of the non-photosensitive oxidizing agent.

According to need, the post-activation type dry image forming material of the present invention may comprise in addition to the foregoing essential components a variety of additives such as a film forming binder, a chemical sensitizer, a toner for a silver image, a development promotor and/or a spectral sensitizing dye.

Among chemical sensitizers which improve the sensitivity of the dry image forming material of the present invention, those spoiling greatly the storage stability of the dry image forming material prior to the use thereof are not preferred. As chemical sensitizers which substantially improve the sensitivity of but not substantially spoil the storage stability of the dry image forming material of the present invention, there can be mentioned, for example, amide compounds as disclosed in Japanese Patent Application Laid-Open Specification No. 51-7914, e.g. 1-methyl-2-pyrrolidone; quinoline compounds as disclosed in Deutsche Offenlegungsschrift No. 2,845,187 and represented by the following general formula:

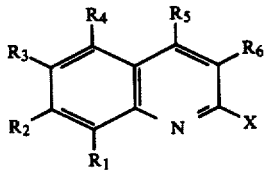

wherein $R_1$, $R_2$, $R_3$, $R_4$, $R_5$ and $R_6$, which are the same or different, each are a hydrogen atom, an aryl group selected from phenyl and naphthyl groups unsubstituted or substituted with methyl, methoxy or halogen, a $C_1$–$C_{10}$ straight chain or branched alkyl group, a $C_1$–$C_4$ alkoxyl group, an aralkyl group selected from benzyl and phenethyl groups unsubstituted or substituted with methyl, methoxy or halogen, a hydroxyl group, a cyano group, a carboxyl group, a $C_2$–$C_5$ alkoxycarbonyl group, a nitro group, an amino group or a carbamoyl group, and X is a hydrogen atom, a hydroxyl group or an amino group; and 3-pyrazolin-5-one compounds as disclosed in Deutshe Offenlegungsschrift No. 2,934,751 and represented by the following formula:

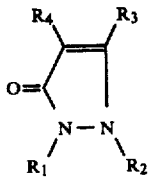

wherein $R_1$ is a hydrogen atom, a $C_1$–$C_5$ straight chain or branched alkyl group, an unsubstituted or substituted phenyl group or an unsubstituted or substituted $C_3$–$C_8$ cycloalkyl group, $R_2$ is a $C_1$–$C_5$ straight chain or branched alkyl group, an unsubstituted or substituted phenyl group or an unsubstituted or substituted $C_3$–$C_8$ cycloalkyl group, and $R_3$ and $R_4$ are the same or different and each represent a hydrogen atom, a $C_1$–$C_5$ straight chain or branched alkyl group, an unsubstituted or substituted phenyl group or an unsubstituted or substituted phenylalkyl group having a $C_1$–$C_5$ straight chain or branched alkyl moiety. They may be used either alone or in combination and preferably in an amount of 5 to 50 mole %, based on the non-photosensitive oxidizing ingredient of the component (II). Specific examples of 3-pyrazolin-5-one compounds include 2-phenyl-3-pyrazolin-5-one, 1-(p-iodophenyl)-2,3-dimethyl-3-pyrazolin-5-one, 2,3,4-triphenyl-3-pyrazolin-5-one, 1-phenyl-2,3-dimethyl-3-pyrazolin-5-one, 1,3-diethyl-2-phenyl-3-pyrazolin-5-one, 2,3-dimethyl-1-ethyl-4-isopropyl-3-pyrazolin-5-one, 2-o-tolyl-3-methyl-4-ethyl-3-pyrazolin-5-one, 2-cyclohexyl-3-pyrazolin-5-one, 2-methyl-1,3-dephenyl-3-pyrazolin-5-one and 1-cyclohexyl-2,3-dimethyl-3-pyrazolin-5-one. The post-activation type dry image forming material containing a chemical sensitizer as mentioned above for improving the sensitivity exerts the effects as intended in the present invention.

The film forming binder is needed for film formation in most cases, but when the organic silver salt oxidizing agent and/or the reducing agent has the function as a binder, the use of binder may be omitted. Natural or synthetic polymeric substances may be used as the binder. Representative examples of the binder include polyvinyl butyral, polymethyl methacrylate, cellulose acetate, polyvinyl acetate, cellulose acetate propionate, cellulose acetate butyrate, vinyl chloride-vinyl acetate copolymers, polyvinyl alcohol, polystyrene, polyvinyl formal and gelatin. Polyvinyl butyral is the most preferred film forming binder. They may be used either alone or in combination. It is suitable that the binder be used in such an amount that the weight ratio of the binder to the non-photosensitive ingredient of the component (II) is in the range of from about 0.1 to about 10.

As the toner for a silver image, there can be mentioned, for example, phthalazinone, zinc acetate, cadmium acetate, phthalimide and succinimide. They may be used either alone or in combination. The amount of the toner for a silver image is preferably in the range of from 1 to 100 mole %, based on the non-photosensitive oxidizing ingredient of the component (II).

The preferred method of preparing the dry image forming material of this invention is described by way of example as follows. An organic silver salt oxidizing agent is dispersed in a binder solution or emulsion by means of a sand grinder, a mixer, a ball mill or the like. To the resulting dispersion are added the other components and optionally various additives. The composition thus obtained is applied onto a support such as a plastic film, a glass plate, a paper or a metal plate, followed by drying, to prepare a dry image forming material. As the plastic film, there can be mentioned a polyethylene film, a cellulose acetate film, a polyethylene terephthalate film, a polyamide film, a polypropylene film and the like. The dry thickness of the coating as the image forming layer may be 1 to 100μ, preferably 3 to 20μ. The components of the composition may optionally be applied in two or more separate but contiguous layers. For the purposes of the protection of the heat-developable image forming layer and so on, a top coat may be provided. The material for the top coat may be chosen from among the binder materials as mentioned hereinbefore.

The sheet material so prepared is non-photosensitive under normal lighting conditions and it can be handled in a light room. When a given area of this sheet material is heated in the dark, this area is rendered photosensitive. This preliminary heating is preferably carried out at a temperature of about 90° to about 130° C. If the heating temperature is elevated, the heating time may be proportionally short. When the area rendered photosensitive by heating is exposed imagewise to light and then heat-developed, a visible image is obtained. It is preferred that heat development be carried out at a temperature of about 90° to about 150° C. The heating period of time at either preliminary heating or heat development may be controlled within the range of from about 1 to about 30 seconds. When the preliminary heating for rendering the material photosensitive and the heat development are conducted at the same temperature, the time for the heat development is generally longer than the time for the preliminary heating. In the image forming material of this invention, a visible image can be recorded selectively on a given area, and updated information may be additionally recorded on other area according to need.

This invention will now be described in more detail by reference to the following Examples that by no means limit the scope of the invention.

In the following Examples and Comparative Examples, the sensitivity and storage stability of dry image forming material are evaluated as follows.

The sensitivity of dry image forming material is defined to be expressed by the reciprocal of amount of exposure light required for giving an optical density (O.D.) 0.6 higher than the minimum optical density (O.D.min) of dry image forming material. Relative sensitivity (R.S.) is given herein in terms of a ratio of the sensitivity of dry image forming material to the sensitivity of the dry image forming material (A4) (which was prepared in Example 1 given later), the relative sensitivity of which is, therefore, defined as 1.

Conditions of Image Formation

A dry image forming material is preliminarily heated on a hot plate maintained at about 100° C. for 5 seconds in a dark room to render it photosensitive. Then, the material is exposed through a 21-step steptablet (manufactured and sold by Eastman Kodak Co., Ltd., U.S.A.) to light from a 300-watt tungsten lamp for 1 second and is heated on a hot plate maintained at about 120° C. for 5 seconds in the dark room to effect heat development.

The storage stability of raw dry image forming material is judged from an increase in minimum optical density (O.D. min) of raw dry image forming material allowed to stand under accelerated deteriorating conditions when compared with the minimum optical density of the one just after preparation thereof.

Accelerated Deteriorating Conditions (unless otherwise specified)

Testing machine: readerprinter #500 (trade name of an accelerated deterioration testing machine manufacutured and sold by Minnesota Mining And Manufacturing Company, U.S.A.)

Light Exposure: for a period of time as indicated in each Example and Comparative Example In Examples, the symbol (A) indicates the materials of the present invention and the symbol (B) indicates the comparative materials.

EXAMPLE 1 AND COMPARATIVE EXAMPLE 1

To 20 g of a mixed solvent of toluene and methyl ethyl ketone (mixing weight ratio = 1:2) was added 3 g of silver behenate, and the mixture was ball-milled for 18 hours to obtain a homogeneous silver behenate suspension.

To 1.5 g of the silver behenate suspension were added ingredients [I] as shown below to form a silver behenate emulsion. The silver behenate emulsion was uniformly applied onto a 100μ-thick polyethylene terephthalate film at an orifice of 100μ, and the coating was air-dried at room temperature (about 20° C.). About 2 g of a reducing agent-containing composition composed of ingredients [II] as shown below was uniformly applied as a second layer onto the dried film of the coating of the silver behenate emulsion at an orifice of 75μ and the coating was air-dried at room temperature (20° C.) to obtain a dry image forming material (A1) having a total coating layer thickness of about 12μ. The preparation of this image forming material was conducted in a light room all the time.

| | |
|---|---|
| Ingredients [I] | |
| 10 Weight % solution of polyvinyl butyral in methyl ethyl ketone | 2.0 g |
| Solution of 100 mg of mercuric acetate in 3 cc of methanol | 0.15 cc |
| α,α,α',α'-Tetrabromo-o-xylene | 25 mg |
| Triphenylphosphite | 3 mg |
| Iodine | 8 mg |
| Diphenylbromomethane | 4 mg |
| Quinoline | 30 mg |
| Ingredients [II] | |
| Cellulose acetate | 6.3 g |
| 2,2'-Methylenebis(4-ethyl-6-tert-butylphenol) | 3.5 g |
| Phthalazinone | 1.2 g |
| Acetone | 83 g |

The dry image forming material (A1) was preliminarily heated on a hot plate maintained at about 100° C. for 5 seconds in a dark room to render it photosensitive. Then, the material was exposed through a 21-step steptablet (manufactured and sold by Eastman Kodak Co., Ltd., U.S.A.) to light from a 300-watt tungsten lamp for 1 second. When the exposed material was heated on a hot plate maintained at about 120° C. for 5 seconds in a dark room, a black negative image was obtained.

A dry image forming material (A2) was prepared in substantially the same manner as described above except that 9.4 mg of iodine was used instead of 8 mg of iodine and 1 mg of diphenylbromomethane was used instead of 4 mg of diphenylbromomethane.

A dry image forming material (A3) was prepared in substantially the same manner as described above except that 4.9 mg of iodine was used instead of 8 mg of iodine and 9.3 mg of diphenylbromomethane was used instead of 4 mg of diphenylbromomethane.

A dry image forming material (A4) was prepared in substantially the same manner as described above except that the use of diphenylbromomethane was omitted from the ingredients [I].

A dry image forming material (A5) was prepared in substantially the same manner as described above except that 3.1 mg of iodine was used instead of 8 mg of iodine and 13.5 mg of diphenylbromomethane was used instead of 4 mg of diphenylbromomethane.

A comparative dry image forming material (B1) was prepared in substantially the same manner as described above except that the use of iodine was omitted from the ingredients [I] and 24 mg of diphenylbromomethane was used instead of 4 mg of diphenylbromomethane.

A comparative dry image forming material (B2) was prepared in substantially the same manner as described above except that the use of mercuric acetate was omitted from the ingredients [I].

A comparative dry image forming material (B3) was prepared in substantially the same manner as described above except that the use of α,α,α',α'-tetrabromo-o-xylene was omitted from the ingredients [I].

The results obtained with respect to relative sensitivity (R.S.) and storage stability of each of the image forming materials are shown in Table 1.

TABLE 1

| Image Forming Material | Molar Ratio of I/Br in Silver Halide | Component (III) | Component (IV) | R.S. | Storage Stability (O.D. min) (accelerated deterioration) 0 hr | 1 hr |
|---|---|---|---|---|---|---|
| A1 | 79/21 | contained | contained | 10 | 0.08 | 0.09 |
| A2 | 95/5 | contained | contained | 8 | 0.08 | 0.09 |
| A3 | 51/49 | contained | contained | 12 | 0.08 | 0.11 |
| A4 | 100/0 | contained | contained | 1 | 0.08 | 0.09 |
| A5 | 31/69 | contained | contained | 0.8 | 0.08 | 0.15 |
| B1 | 0/100 | contained | contained | 0.5 | 0.08 | 1.4 |
| B2 | 79/21 | not contained | contained | 15 | 0.08 | 1.6 |
| B3 | 79/21 | contained | not contained | 10 | 0.08 | 1.5 |

COMPARATIVE EXAMPLE 2

A dry image forming material (B4) was prepared in substantially the same manner as disclosed in U.S. Pat. No. 3,802,888.

A silver behenate emulsion as prepared in Example 1 was uniformly applied onto a 100μ-thick polyester film at an orifice of 130μ and air-dried at room temperature.

A solution containing 0.05 g of $HgBr_2$ and 0.1 g of $CaBr_2$ dissolved in 50 g of a solution composed of 10 g of cellulose acetate butyrate, 100 g of methanol, 2 g of phthalazinone, 50 ml of acetone and 6 g of 1,1-bis(2-hydroxy-3,5-dimethylphenyl)-3,5,5-trimethylhexane was applied as a second layer onto the silver behenate emulsion layer at an orifice of 80μ and air-dried at room temperature to prepare a dry image forming material (B4).

The material (B4) was allowed to stand for 5 minutes under accelerated deteriorating conditions. Using the resulting material (B4), image formation was carried out in the same manner as described with respect to the material (A1) in Example 1. The material (B4) was blackened all over the surface thereof only by the preliminary heating, thus showing poor storage stability of the raw material (B4). It will be easily understood that the dry imaging materials (A1) to (A5) of the present invention are very excellent in storage stability of raw material over the dry image forming material (B4).

EXAMPLE 2 AND COMPARATIVE EXAMPLE 3

To 1.5 g of a silver behenate suspension as prepared in the same manner as described in Example 1 and Comparative Example 1 were added ingredients [III] as shown below to form a silver behenate emulsion. Substantially the same procedures as in Example 1 except that the silver behenate emulsion prepared just above was used instead of the silver behenate emulsion prepared in Example 1 were repeated to prepare a dry image forming material.

| Ingredients [III] | |
|---|---|
| 10 Weight % solution of polyvinyl butyral in methyl ethyl ketone | 2.0 g |
| Solution of 100 mg of mercuric acetate in 3 cc of methanol | 0.15 cc |
| Triphenylphosphite | 3 mg |
| Iodine | 8 mg |
| Cobalt dibromide | 3 mg |
| 1-Phenyl-2,3-dimethyl-3-pyrazolin-5-one | 30 mg |
| Halogen containing-compound (photoreactive oxidizing agent) indicated in Table 2 | 30 mg |

According to the above-mentioned procedures, there were prepared 16 kinds of dry image forming materials, the relative sensitivity (R.S.) and storage stability of each of which are shown in Table 2.

TABLE 2

| Image Forming Material | Halogen-Containing Compound (Photoreactive Oxidizing Agent) | R.S. | Storage Stability (O.D. min) (accelerated deterioration) 0 hr | 1 hr | 3 hr |
|---|---|---|---|---|---|
| A6 | α,α,α',α'-tetrabromo-o-xylene | 15 | 0.08 | 0.08 | 0.09 |
| A7 | α,α,α',α'-tetrabromo-m-xylene | 15 | 0.08 | 0.08 | 0.09 |
| A8 | ethyl α,α,α-tribromoacetate | 12 | 0.08 | 0.08 | 0.12 |
| A9 | α,α,α-tribromoacetophenone | 15 | 0.08 | 0.08 | 0.15 |
| A10 | α,α,α-tribromo-p-bromotoluene | 13 | 0.08 | 0.09 | 0.13 |
| A11 | 1,1,1-tribromo-2,2-diphenylethane | 15 | 0.08 | 0.08 | 0.15 |
| A12 | 2,2,2-tribromoethanol | 15 | 0.08 | 0.08 | 0.3 |
| A13 | tetrabromomethane | 3 | 0.08 | 0.08 | 0.08 |
| B5 | pentabromoethane | 6 | 0.08 | 0.12 | 0.50 |
| B6 | 1,2,3,4-tetrabromobutane | 15 | 0.08 | 0.30 | 0.70 |
| B7 | α,α,α-tribromoquinaldine | 5 | 0.08 | 0.35 | 0.90 |
| B8 | hexabromocyclohexane | 15 | 0.08 | 0.40 | 1.2 |
| B9 | iodoform | 5 | 0.08 | 1.8 | |
| B10 | 1,2-diiodoethane | 15 | 0.08 | 1.8 | |
| B11 | pentachloroethane | 15 | 0.08 | 1.8 | |
| B12 | hexachloroethane | 15 | 0.08 | 1.8 | |

The halogen-containing compounds used in the preparation of the materials (B5) to (B12) were those which did not form a silver halide in such an amount as can be observed in the aforementioned photoreaction test.

It is apparent from Table 2 that the materials (A6) to (A13) containing a halogen-containing compound which had formed a silver halide in the aforementioned photoreaction test were by far superior in storage stability under accelerated deteriorating conditions to the comparative materials (B5) to (B12). Tetrabromomethane had a tendency to lower the sensitivity of the image forming material containing the same but imparted an excellent storage stability to the raw image forming material containing the same as is apparent from the data of the material (A13) in Table 2.

EXAMPLE 3 AND COMPARATIVE EXAMPLE 4

To 1.5 g of a silver behenate suspension as prepared in the same manner as described in Example 1 and Comparative Example 1 were added ingredients [IV] as shown below to form a silver behenate emulsion. Substantially the same procedures as in Example 1 except that the silver behenate emulsion prepared just above was used instead of the silver behenate emulsion prepared in Example 1 were repeated to prepare a dry image forming material (A14).

| Ingredients [IV] | |
|---|---|
| 10 Weight % solution of polyvinyl butyral in methyl ethyl ketone | 2.0 g |
| Solution of 100 mg of mercuric acetate in 3 cc of methanol | 0.15 cc |
| N—Iodosuccinimide | 17 mg |
| Diphenylbromomethane | 4 mg |
| N—Methyl-2-pyrrolidone | 400 mg |
| α,α,α',α'-Tetrabromo-o-xylene | 30 mg |

A dry image forming material (B13) was prepared in substantially the same manner as described above except that the use of mercuric acetate was omitted from the ingredients [IV].

A dry image forming material (B14) was prepared in substantially the same manner as described above except that the use of α,α,α',α'-tetrabromo-o-xylene was omitted from the ingredients [IV].

The results obtained with respect to relative sensitivity (R.S.) and storage stability of each of the image forming materials are shown in Table 3.

TABLE 3

| Image Forming Material | Molar Ratio of I/Br in Silver Halide | Component (III) | Component (IV) | R.S. | Storage Stability (O.D. min) (accelerated deterioration) 0 hr | 1 hr |
|---|---|---|---|---|---|---|
| A14 | 79/21 | contained | contained | 5 | 0.08 | 0.14 |
| B13 | 79/21 | not contained | contained | 8 | 0.08 | 1.6 |
| B14 | 79/21 | contained | not contained | 5 | 0.08 | 1.6 |

It is apparent from Table 3 that the material (A14) of the present invention was by far superior in storage stability to the comparative materials (B13) and (B14).

EXAMPLE 4

Substantially the same procedures as in Example 2 except that, instead of cobalt dibromide, triphenylphosphine dibromide was used in an equimolar amount with that of cobalt dibromide used in Example 2 were repeated to prepare a post-activation type dry image forming material (A15).

The results obtained with respect to relative sensitivity (R.S.) and storage stability of the material (A15) are shown in Table 4.

TABLE 4

| R.S. | Storage Stability (O.D.min) (accelerated deterioration) 0 hr | 1 hr | 3 hr |
|---|---|---|---|
| 15 | 0.08 | 0.08 | 0.10 |

EXAMPLE 5 AND COMPARATIVE EXAMPLE 5

To 1.5 g of a silver behenate suspension as prepared in the same manner as described in Example 1 and Comparative Example 1 were added ingredients [V] as shown below to form a silver behenate emulsion. This emulsion was uniformly applied onto a 100μ-thick polyester film at an orifice of 100μ, and the coating was sufficiently air-dried at room temperature (20° C.). About 2 g of a reducing agent-containing composition composed of ingredients [VI] as shown below was uniformly applied as a second layer onto the dried film of the coating of the silver behenate emulsion at an orifice of 75μ and the coating was air-dried at room temperature (20° C.) to obtain a dry image forming material (A16) having a total coating layer thickness of about 12μ. The preparation of this image forming material was conducted under a red safe light.

| Ingredients [V] | |
|---|---|
| 10 Weight % solution of polyvinyl butyral in methyl ethyl ketone | 2.0 g |
| Solution of 100 mg of mercuric acetate in 3 cc of methanol | 0.15 cc |
| Silver iodide | 8.2 mg |
| Silver bromide | 1.6 mg |
| α,α,α',α'-Tetrabromo-o-xylene | 25 mg |
| 2-Phenyl-3-pyrazolin-5-one | 30 mg |
| Ingredients [VI] | |
| 2,6-Methylenebis(2-hydroxy-3-tert-butyl-5-methylphenyl)-4-methylphenol | 3.5 g |
| Cellulose acetate butyrate | 6.3 g |
| Phthalazinone | 1.2 g |
| Acetone | 83 g |

A dry image forming material (B15) was prepared in substantially the same manner as described above except that the use of silver iodide was omitted from the ingredients [V] and 8.3 mg of silver bromide was used instead of 1.6 mg of silver bromide.

The storage stability of raw image forming material was examined as follows. The materials (A16) and (B15) were exposed for 1 hour to light in a 3-kilowatt xenon fadeometer Model FX-1 (trade name of a xenon fadeometer manufactured and sold by Suga Shikenki K.K., Japan). Thereafter, the preliminary heating, light exposure and heat development of the resulting materials (A16) and (B15) were carried out in the same manner as described before with respect to "conditions of image formation". The minimum optical density of the material (A16) was 0.10 while the minimum optical density of the material (B15) was 1.5.

On the other hand, the relative sensitivity of the material (A16) was 10 times as high as that of the material (B15).

EXAMPLE 6

To 1.5 g of a silver behenate suspension as prepared in the same manner as described in Example 1 and Comparative Example 1 were added ingredients [VII] as shown below to form a silver behenate emulsion. Substantially the same procedures as in Example 1 except that the silver behenate emulsion prepared just above was used instead of the silver behenate emulsion prepared in Example 1 were repeated to prepare a dry image forming material.

| Ingredients [VII] | |
|---|---|
| 10 Weight % solution of polyvinyl butyral in methyl ethyl ketone | 2.0 g |
| α,α,α',α'-Tetrabromo-o-xylene | 25 mg |
| Triphenylphosphite nonaiodide[$(C_6H_5O)_3PI_9$] | 23 mg |
| 2,3,4-Triphenyl-3-pyrazolin-5-one | 30 mg |

Oxidizing agent for free silver indicated in Table 5.

According to the above-mentioned procedures, there were prepared 3 kinds of dry image forming materials, the relative sensitivity (R.S.) and storage stability of each of which are shown in Table 5.

TABLE 5

| Image Forming Material | Oxidizing Agent for Free Silver | R.S. | Storage Stability (O.D. min) (accelerated deterioration) 0 hr | 1 hr |
|---|---|---|---|---|
| A17 | solution of 100 mg of mercuric bromide in 10 cc of acetone (0.2 cc) N—bromosuccinimide (3 mg) | 15 | 0.08 | 0.08 |
| A18 | acetylacetonatocobalt(III) (5 mg) nickel dibromide (5 mg) | 10 | 0.08 | 0.11 |
| A19 | acetylacetonatopalladium(II) cobalt dibromide (5 mg) | 10 | 0.08 | 0.10 |

The period of time for which a dry image forming material is allowed to stand under "accelerated deteriorating conditions" as specified before corresponds to $10^3$–$10^4$ times the period of time for which the dry image forming material is allowed to stand under normal conditions for storage in a light room. Conventional dry image forming materials such as those disclosed in U.S. Pat. No. 3,802,888 can be stored in a light room only for such a short period of time of the order of hours that they cannot be used as recording materials capable of recording thereon additional up-dated information. On the other hand, as is apparent from Examples given above, the dry image forming materials of the present invention can be stored for such a long period of time of the order of years that they can record thereon any additional up-dated information. Further, since the image forming materials of the present invention have such a high sensitivity as to enable photographing by means of a camera, they are very useful from the practical point of view.

What is claimed is:

1. A post-activation type dry image forming material possessing an improved storage stability comprising:

(I) a silver halide component reducible to free silver upon being exposed to light and consisting of silver iodide and silver bromide in a molar ratio of 50/50 to 95/5;

(II) a redox reactive composition comprising a non-photosensitive organic silver salt oxidizing agent and a reducing agent for silver ion, said redox reactive composition being capable of making a visual change according to a redox reaction of said composition, the redox reaction being initiated by heating said composition in the presence of free silver;

(III) an oxidizing agent for free silver comprising at least one member selected from the group consisting of a compound of divalent mercury, a compound of trivalent iron, a compound of divalent palladium, a compound of trivalent cobalt and a sulfinic acid compound respectively in amounts of 0.2 to 7 mole %, 0.01 to 1 mole %, 0.01 to 10 mole %, 0.01 to 1 mole % and 0.05 to 10 mole % based on said non-photosensitive organic silver salt oxidizing agent, said oxidizing agent for free silver having a capacity of oxidizing free silver and being capable of being rendered photosensitive by heating but, upon being exposed to light after said heating, being suppressed with respect to the capacity of oxidizing free silver and capable of catalytically promoting the redox reaction of said redox reactive composition; and (IV) a photoreactive oxidizing agent comprising at least one bromo compound in which a carbon atom is bonded to a bromine atom and which is capable of generating a free radical of bromine upon light exposure and satisfies a requirement in a photoreaction test using a film containing said bromo compound, silver behenate and polyvinyl butyral such that (1) when the film is examined by X-ray diffractometry, the intensity of the peak due to silver bromide observed at 31.0° in terms of an angle of 2 θ in the X-ray diffraction pattern obtained by using, Cukα line is less than about 19 relative to 100 as the intensity of the peak due to silver behenate observed at 12.1° in terms of an angle of 2 θ as defined above; and (2) when the film is irradiated with a 20,000 luxes-light from a fluorescent lamp at 75° C. in an atmosphere of a relative humidity of 30% for one hour, and then examined by X-ray diffractometry, the intensity of the peak due to silver bromide observed at 31.0° in terms of an angle of 2θ as defined above is about 10 or more relative to 100 as the intensity of the peak due to silver behenate observed at 12.1° in terms of an angle of 2 θ as defined above, said photoreactive oxidizing agent, upon being exposed to light, being capable of returning to the original state said oxidizing agent for free silver which has been reduced by serving to oxidize the free silver.

2. A post-activation type dry image forming material according to claim 1, wherein said compound of divalent mercury is mercuric acetate, mercuric bromide or mercuric iodide.

3. A post-activation type dry image forming material according to claim 1, wherein said bromo compound is α,α,α',α'-tetrabromo-o-xylene, α,α,α',α'-tetrabromo-m-xylene, ethyl α,α,α-tribromoacetate, α,α,α-tribromo-p-bromotoluene, α,α,α-tribromoacetophenone, 1,1,1-tribromo-2,2-diphenylethane or 2,2,2-tribromoethanol.

4. A post-activation type dry image forming material according to claim 1, wherein said silver iodide is one prepared by the reaction between said non-photosensitive, organic silver salt oxidizing agent and iodine or a complex of iodine.

5. A post-activation type dry image forming material according to claim 1, which further comprises at least one member selected from the group consisting of 3-pyrazoline-5-one compounds represented by the following formula:

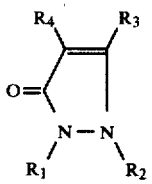

wherein $R_1$ is a hydrogen atom, a $C_1$–$C_5$ straight chain or branched alkyl group, an unsubstituted or substituted phenyl group or an unsubstituted or substituted $C_3$–$C_8$ cycloalkyl group, $R_2$ is a $C_1$–$C_5$ straight chain or branched alkyl group, an unsubstituted or substituted phenyl group or an unsubstituted or substituted $C_3$–$C_8$ cycloalkyl group, and $R_3$ and $R_4$ are the same or different and each represent a hydrogen atom, a $C_1$–$C_5$ straight chain or branched alkyl group, an unsubstituted or substituted phenyl group or an unsubstituted or substituted phenylalkyl group having a $C_1$–$C_5$ straight chain or branched alkyl moiety.

* * * * *